United States Patent [19]

Kagechika et al.

[11] Patent Number: 4,906,533

[45] Date of Patent: Mar. 6, 1990

[54] ALUMINUM-PLATED STEEL SHEET FOR CANS

[75] Inventors: Hiroshi Kagechika; Tadahiko Mishima; Yoshinori Yomura; Hiroshi Ishikawa; Naoyuki Oniwa; Yoshihiko Yasue; Hiroshi Kibe, all of Tokyo, Japan

[73] Assignee: NKK Corporation, Tokyo, Japan

[21] Appl. No.: 280,147

[22] Filed: Dec. 2, 1988

[30] Foreign Application Priority Data

Dec. 10, 1987 [JP] Japan ..... 62-313013

[51] Int. Cl.[4] ..... B32B 15/01

[52] U.S. Cl. ..... 428/651; 220/456; 428/667; 428/935

[58] Field of Search ..... 428/651, 666, 667, 684, 428/935; 220/456

[56] References Cited

U.S. PATENT DOCUMENTS 3,653,852 4/1972 Seiler ..... 428/667

4,455,355 6/1984 Inui et al. ..... 428/667

FOREIGN PATENT DOCUMENTS 21139 1/1988 Japan ..... 428/667

*Primary Examiner*—Robert McDowell

*Attorney, Agent, or Firm*—Frishauf, Holtz, Goodman & Woodward

[57] ABSTRACT

The invention relates to a plated steel sheet for cans which must have high workability and corrosion resistance and can prevent bimetallic corrosion and a method of manufacturing the same. The plated steel sheet is manufactured by forming an electroplated chromium layer on the surface of a steel, removing a hydrated chromium oxide layer formed on the surface of the chromium layer, and forming an aluminum plating layer, so that the electroplated chromium layer and the aluminum plating layer are stacked in direct contact with each other. Another plated steel sheet is manufactured by forming a vacuum deposited chromium layer on the surface of a steel, and forming an aluminum plating layer.

5 Claims, 1 Drawing Sheet

ALUMINUM-PLATED STEEL SHEET FOR CANS

BACKGROUND OF THE INVENTION

1. Field of the Invention

The present invention relates to a plated steel sheet used for cans such as food cans and, more particularly, to a plated steel sheet suited to food cans adopting an aluminum easy-open top.

2. Description of the Prior Art

Tin-plated steel sheet, tin free steel (obtained by forming a chromium plating layer on the surface of a steel sheet and forming a hydrated chromium oxide layer thereon), and aluminum plates have been conventionally widely used as can materials. As easy-open tops are increasingly used for drink cans, full-open end cans adopting an aluminum easy-open top have been recently used for food cans. Easy-open cans of this type can be conveniently opened without a can opener and therefore are strongly demanded. For this reason, a demand has arisen for supply of inexpensive and reliable can materials.

Conventionally, both a can top and a can body of a full-open end can are made of aluminum. Aluminum is, however, more expensive than a tin-plated steel sheet or a chromium-plated steel sheet, and its strength is unsatisfactory. Therefore, aluminum is damaged during handling, or defective cans are sometimes produced. In addition, although aluminum has a good corrosion resistance to general food, its corrosion resistance to highly corrosive can contents containing a large amount of salt such as salted food or food cooked with soy sauce is not satisfactorily reliable.

In consideration of the above situation, a method has been proposed in which properties of both aluminum and steel are utilized, i.e., soft aluminum is used as an easy-open top and a surface-treated steel sheet having strength and an under film corrosion resistance is used as a can body which must have strength so that a corrosion resistance against a can content is obtained by a paint coated on the inner surface of the can. One of a can body and a can top made of different materials is selectively dissolved and corroded, i.e., a problem of so-called bimetallic corrosion is posed. The bimetallic corrosion is a phenomenon in which when two types of metals having different electrode potentials are placed in the presence of an electrolyte and are electrically brought into contact with each other, both the metals serve as electrodes to form a cell, a current flows between the metals from a relatively noble one to a base one through a contact point therebetween, and the base metal is ionized and dissolved. When a can top is made of aluminum and a can body is made of a tin-plated steel sheet, aluminum serves as a base metal and tin serves as a noble metal. Therefore, aluminum is ionized by an anode reaction, and hydrogen is produced on the surface of tin plating by a cathode reaction. If the aluminum top has a film defect, this defect portion is locally dissolved, and a hole is produced by pitting. At the same time, a film on the tin plating is peeled by hydrogen produced at the cathode to corrode the tin-plated steel sheet. This phenomenon similarly occurs in tin free steel. Especially when chlorine ions are contained in a can content, the aluminum top turns to a base metal more easily, and the phenomenon occurs more significantly.

In order to prevent such bimetallic corrosion, a method of increasing the strength of a film coated on the inner surface of a can is studied, but a cost is inevitably increased in this method. In addition, a method is studied in which a potential behavior of an aluminum top is examined to make some improvements in an aluminum alloy designing step (see, for example, "Iron and Steel", 1987, Vol. 3, PP. 427 to 436). This method is, however, not practically used yet.

Aluminum can be plated on a steel sheet by conventional techniques. Examples of the conventional techniques are a method of manufacturing an aluminum single layer-plated steel sheet utilizing vapour deposition (Japanese Patent Publication Nos. 45-5123, 45-19762, 46-39445 and 59-32544) and a method of manufacturing a steel sheet having different metals, i.e., aluminum as an upper layer and Ti, Cr or Zn as a lower layer formed thereon (Japanese Patent Publication Nos. 46-4047, 46-25608 and 46-42006). Both of these methods, however, aim at improving a corrosion resistance of a steel sheet such as resistance to sprayed salt water but do not aim at using such a plate as a can material. Therefore, in these methods, an under film corrosion resistance is not taken into consideration at all.

As described above, an aluminum-plated steel sheet aiming at improving a general corrosion resistance to serve as a can body material of a convenient full-open can have a problem of an under film corrosion resistance. On the other hand, a tin-plated steel sheet or tin free steel as a conventional can material having an under film corrosion resistance poses a problem of bimetallic corrosion.

SUMMARY OF THE INVENTION

It is, therefore, a first object of the present invention to provide a plated steel sheet for cans in which no bimetallic corrosion occurs between the steel sheet and an aluminum top and which has a high under film corrosion resistance.

It is a second object of the present invention to provide a plated steel sheet for cans which can be manufactured at low cost.

In order to achieve the above objects of the present invention, there is provided an aluminum-plated steel sheet for cans manufactured by forming an electroplated chromium layer having a thickness of 0.005 μm to 0.05 μm without a hydrated chromium oxide layer on the surface of a steel sheet and forming an aluminum plating layer having a thickness of 0.01 μm or more thereon. In addition, according to the present invention, there is provided a method of manufacturing a plated steel sheet, comprising the steps of: forming a chromium plating layer having a thickness of 0.005 to 0.05 μm on the surface of a steel sheet by electroplating and at the same time forming a hydrated chromium oxide layer on the surface; removing the hydrated chromium oxide; and coating aluminum on the surface of the electroplated chromium layer, from which the hydrated chromium oxide layer is removed, to a thickness of 0.01 μm or more.

According to the plated steel sheet for cans of the present invention, the brittle hydrated chromium oxide layer is removed, and then the aluminum plating layer is directly formed on the electroplated chromium layer. Therefore, the steel sheet which maintains its high under film corrosion resistance even after it is formed into cans and in which no bimetallic corrosion occurs between the steel sheet and an aluminum top can be provided at low cost.

Another plated steel sheet for cans according to the present invention is manufactured by sequentially forming a vacuum deposited chromium layer having a thickness of 0.1 to 0.7 μm, an aluminum layer having a thickness of 0.05 to 0.4 μm, and an aluminum chemical conversion layer on a steel sheet. A thickness ratio of the aluminum layer to all the layers is 0.2 to 0.7.

DETAILED DESCRIPTION OF THE PREFERRED EMBODIMENTS

Figure 1:
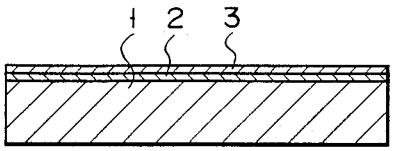
FIG. 1 is a schematic sectional view showing a plated steel sheet for cans according to the present invention.

A plated steel sheet of the present invention shown in FIG. 1 comprises electroplated chromium layer 2 having a thickness of 0.005 μm to 0.05 μm and formed on the surface of steel sheet 1, and aluminum plating layer 3 having a thickness of 0.01 μm or more and formed on the surface of layer 2. The aluminum plating layer is a layer for eliminating a potential difference in a can and preventing bimetallic corrosion of an aluminum top and must be formed to a thickness of 0.01 μm or more so as to uniformly cover the entire steel sheet surface. A preferable upper limit of the thickness of the aluminum plating layer is 5 μm. A composition of the aluminum layer is the same as that of pure aluminum or an aluminum material of an easy-open top. If aluminum is directly plated on a steel sheet, an electrode potential difference between aluminum and steel is increased. Therefore, even a small detect of a plated film forms a cell between the plating layer and the steel sheet in a can. As a result, bimetallic corrosion easily occurs to degrade an under film corrosion resistance of the plating layer. In order to solve the above problem, according to the steel sheet of the present invention, chromium plating layer 2 is formed between steel sheet 1 and aluminum plating layer 3. Since an electrode potential of chromium is intermediate between aluminum and steel, the potential difference between aluminum and chromium is reduced. Therefore, the bimetallic corrosion between the plating layer and the steel can be prevented to maintain the high under film corrosion resistance. In addition, the chromium plating layer can galvanically protect steel against corrosion. Therefore, even if the plating layer has a defect, local corrosion at this place can be suppressed. Even a thin chromium plating layer has a good corrosion resistance. In addition, since a mass production technique is established for electroplating of chromium, inexpensive products can be promisingly supplied. If the thickness of the electroplated chromium layer is less than 0.005 μm, a satisfactory under film corrosion resistance cannot be obtained. A thickness exceeding 0.05 μm is, however, economically disadvantageous. When chromium is plated by electroplating, a hydrated chromium oxide layer is simultaneously formed on the chromium plating layer. This hydrated chromium oxide layer is brittle and therefore is often destroyed during a plated steel sheet manufacturing process. Therefore, if aluminum is plated on the hydrated chromium oxide layer, a satisfactory adhesive property of the film cannot be obtained. For this reason, the electroplated chromium layer should not have the hydrated chromium oxide layer. In a method of the present invention, the hydrated chromium oxide layer formed by electroplating is removed before aluminum is plated. This removing treatment is performed by a dipping treatment using an alkaline solution, plasma sputtering, or a combination of both. In a dissolving method using an alkaline solution as an example of the removing treatment, a steel sheet having a hydrated chromium oxide formed thereon is dipped in a 40 g/l caustic alkali solution at 80° C. for 30 seconds, rinsed with water, and dried. In an electrolytic removing method, a steel sheet is dipped in a 50 g/l chromate solution at 50° C. so that the steel sheet is electrolyzed to be 5 $A/dm^2$ for 15 seconds, and then rinsed with water and dried. In plasma sputtering, a steel sheet is exposed to an RF plasma of 5 kW in an $Ar+H_2$ (20%) atmosphere at $2\times10^{-2}$ Torr for ten minutes. With these removing treatments, the hydrated chromium oxide layer can be efficiently removed without adversely affecting the chromium plating layer.

According to the above method, an electroplated chromium layer from which a brittle hydrated oxide layer is removed is formed on the surface of a steel sheet, and an aluminum layer is directly stacked on this layer. Therefore, a plated steel sheet for cans which has high workability and under film corrosion resistance and does not cause bimetallic corrosion can be easily obtained.

Figure 2:
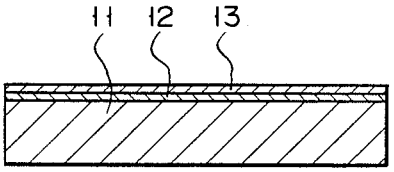
FIG. 2 is a schematic sectional view showing another plated steel sheet for cans according to the present invention.

Another plated steel sheet according to the present invention shown in FIG. 2 comprises chromium layer 12, and aluminum layer 13 sequentially formed on the surface of steel sheet 11. The plated surface of this steel sheet is used as the inner surface of a can. The chromium layer can be formed by vapour deposition, sputtering, ion plating or the like. Of these methods, ion plating is advantageous in uniformity and an adhesive property. The film thickness of the chromium layer is 0.1 to 0.7 μm, and preferably, 0.2 to 0.5 μm. A film thickness range is thus limited because if the film is too thin, under film corrosion occurs; if it is too thick, workability and an adhesive property are degraded. A composition of the chromium layer is not limited to pure chromium but may be an alloy containing various components in an amount not degrading the characteristics of chromium. Similar to the chromium layer, the aluminum layer can be plated by various physical methods. In consideration of a plating rate, however, vapour deposition or ion plating is preferred. The film thickness of the aluminum layer is 0.05 to 0.4 μm, and preferably, 0.1 to 0.3 μm. This is because if the film is too thin, bimetallic corrosion may occur; if it is too thick, under film corrosion may occur. A composition of the aluminum layer is not limited to pure aluminum but may be an alloy containing various components in an amount not degrading characteristics of aluminum. Preferably, the composition of aluminum is identical to that of aluminum used as a can top material. The aluminum chemical conversion layer is, if necessary, formed on the aluminum layer to further increase an under film corrosion resistance. A treating method for this layer comprises such a conventional aluminum chemical conversion treatment that a phosphate treatment, a chromate treatment or a phosphoric acid/chromic acid treatment is performed by dipping in a treating solution, spraying of a treating solution or electrolysis in a treating solution The thickness of the chemical conversion layer is normally about 0.01 to 0.1 μm.

The chromium layer of the present invention effectively, significantly suppresses expansion of local corrosion at a cracked or pore portion. In addition, the aluminum layer causes the potential of a can body made of the steel sheet according to the present invention to be equal to that of an aluminum top, thereby preventing bimetallic corrosion. In such a steel sheet having the chromium layer and the aluminum layer, if the aluminum layer is too thick, a large amount of blisters may be produced after painting to promote under film corrosion. In the present invention, however, since the thickness of the aluminum layer is limited to the above range so that the layer becomes relatively thin, production of blisters can be prevented. Moreover, since the aluminum and chromium layers are stacked, aluminum and chromium are partially alloyed when a can is manufactured by welding. As a result, a melting point is lowered to improve weldability as compared with that obtained when only a chromium layer is formed on a steel sheet. Furthermore, since a thin aluminum layer is formed in the present invention, weldability is better than that obtained when a thick aluminum layer is formed on a steel sheet.

The present invention detail below by way of its examples. In the following description, Examples 1 to 3 correspond to the steel sheet shown in FIG. 1; and Example 4, the steel sheet shown in FIG. 2.

EXAMPLE 1

A commercially available tin-plated steel sheet was prepared. This steel had a chromium plating layer formed on its surface and a hydrated chromium oxide layer formed on the surface of the chromium plating layer. The steel was dipped in a 2N potassium hydroxide solution at 85° C. for five minutes. Then, the steel was subjected to DC plasma sputtering using Ar plasma of 5 kV at $10^{-2}$ Torr for ten minutes, thereby removing a hydrated chromium oxide layer formed on the steel surface. In this treatment, the chromium plating layer was not adversely affected. Then, aluminum was vacuum-deposited on the steel surface from which the hydrated chromium oxide layer was removed using an electron beam for heating a deposition source at a vacuum degree of $10^{-3}$ Torr, a steel temperature of 250° C., and a deposition rate of 0.01 μm/sec, thereby manufacturing steel plates (Nos. 1 to 4) each having an aluminum layer formed on the chromium plating layer. The thicknesses of both the layers are shown in Table 1.

An under film corrosion resistance of each plated steel sheet manufactured as described above was estimated by an accelerated test, and a corrosion state in a can and bimetallic corrosion thereof were estimated by a real can test. The under film corrosion resistance was estimated as follows. That is, 50 mg/dm$^2$ of an epoxy-phenol paint was coated on the plated steel sheet and baked at 205° C. for ten minutes. Thereafter, a cross cut was made to reach the underlying steel surface by a knife, and the resultant material was subjected to 5-mm stretch forming by an Erichsen testing machine, thereby preparing a test piece. The test piece was dipped in a corrosive liquid containing 1.5 wt % of salt and 1.5 wt % of citric acid and having a pH of 3.0 at 70° C. for 20 hours. Thereafter, an adhesive tape was adhered on the film surface and then peeled, and a corrosion width and a film peeled state at this time were observed. The real can test was performed as follows. That is, the plated steel sheet was formed into a can body, a bottom plate was added thereto, and a boiled salmon piece was put into the can. Then, the can was vacuum-packed using an aluminum easy-open top to prepare a full-open end canned food. The canned food was preserved at 37° C. for two months. Thereafter, a corrosion state in the can was observed to estimate a sulfur blackening resistance and a bimetallic corrosion resistance. The result is shown in Table 1.

EXAMPLE 2

A steel sheet was dipped and electroplated at a current density of 50 A/dm$^2$ for 0.2 to 0.8 minutes in a chromic acid bath having a composition of 150 g/l of anhydrous chromic acid and a liquid temperature of 40° C. As a result, an electroplated chromium layer was formed on the surface of the steel sheet, and a hydrated chromium oxide layer was formed on the surface of this layer. The hydrated chromium oxide layer which was naturally formed was removed by plasma sputtering following the same procedures as in Example 1. Then, Al was vacuum-deposited on the surface of the electroplated chromium layer following the same procedures as in Example 1, thereby preparing plated steel sheets (Nos. 5 to 7). The prepared plated steel sheets were tested following the same procedures as in Example 1. The result is shown in Table 1.

EXAMPLE 3

A steel sheet was dipped and electroplated at a current density of 50 A/dm$^2$ for 0.2 minutes in a sulfuric acid bath having a composition of 150 g/l of anhydrous chromic acid and a liquid temperature of 40° C. As a result, an electroplated chromium layer was formed on the surface of the steel sheet, and a hydrated chromium oxide layer was formed on the surface of this layer. The hydrated chromium oxide layer which was naturally formed was removed by plasma sputtering following the same procedures as in Example 1. Then, Al was vacuum-deposited on the surface of the electroplated chromium layer following the same procedures as in Example 1, thereby preparing a plated steel sheet (No. 8). The prepared plated steel sheet was tested following the same procedures as in Example 1. The result is shown in Table 1.

For purposes of comparison of Examples 1 to 3, plated steel sheets (Nos. 9 and 10) as comparative examples in which an electroplated chromium layer without a hydrated chromium oxide layer, and an aluminum layer were formed on the surface of a steel sheet but the aluminum layer was thinner than that of the present invention, and plated steel sheets (Nos. 11 and 12) in which only an aluminum layer was formed on the surface of a steel sheet and tin free steel (No. 13) as conventional examples were tested following the same procedures as in Example 1. The test result is shown in Table 1.

As shown in Table 1, the plates of Comparative Examples Nos. 9 and 10 had poor bimetallic corrosion resistances because the upper aluminum plating layer was thinner than 0.01 μm. Of the conventional examples, the aluminum single layer-plated steel sheets (Nos. 11 and 12) had poor results in a cross cut test and a bimetallic corrosion resistance. This means that the under film corrosion resistance was unsatisfactory and the aluminum plating layer covering the surface before the test was degraded in the real can test. The tin free steel (No. 13) was found to have a good under film corrosion resistance because the result of the cross cut test was good but had a poor bimetallic corrosion resistance. In contrast, the examples Nos. 1 to 8) of the present invention achieved good or very good results in all the tests.

TABLE 1

| Section | No. | Type and Thickness of Plating Layer: Inner Layer Cr | Outer Layer Al | Total | Cross Cut Test | Real Can Test: Sulfer Blackening Resistance | Bimettalic Corrosion Resistance |
|---|---|---|---|---|---|---|---|
| Example 1 | 1 | 0.01 | 0.02 | 0.03 | ○ | ○ | ○ |
| | 2 | 0.01 | 5.3 | 5.31 | ○ | ● | ● |
| | 3 | 0.03 | 0.03 | 0.06 | ● | ○ | ○ |
| | 4 | 0.03 | 6.3 | 6.33 | ○ | ● | ● |
| Example 2 | 5 | 0.01 | 0.15 | 0.16 | ○ | ○ | ● |
| | 6 | 0.01 | 8.6 | 8.61 | ○ | ● | ● |
| | 7 | 0.03 | 0.72 | 0.75 | ● | ● | ● |
| * | 8 | 0.01 | 5.8 | 5.83 | ● | ● | ● |
| Comparative | 9 | 0.01 | 0.005 | 0.015 | ○ | Δ | X |
| Example | 10 | 0.03 | 0.002 | 0.032 | ● | ○ | X |
| Conventional | 11 | — | 0.5 | 0.5 | X | Δ | X |
| Example | 12 | — | 8.0 | 8.0 | X | ○ | Δ |
| | 13 | 0.015 | CrOX 0.01 | 0.025 | ● | ○ | X |

*: Example 3 ●; excellent, ○; good, Δ; poor, X; unsatisfactory

EXAMPLE 4

A solvent-degreased 0.32-mm thick cold rolled steel plate was preheated to 200° C. in a vacuum of $6\times10^{-6}$ Toor. Then, chromium was deposited on the steel sheet, and aluminum was deposited thereon. After the resultant steel sheet was cooled to room temperature, it was dipped in a commercially available aluminum chemical conversion solution (phosphoric acid-chromic acid solution) and then rinsed with water and dried. The thicknesses of the respective layers of the prepared plated steel sheet are shown in Table 2.

50 mg/dm$^2$ of an epoxyphenol paint was coated and baked (at 205° C. for ten minutes) on the plated steel sheet and a cross cut was formed therein. Then, the plated steel sheet was subjected to 5-mm stretch forming using an Erichsen testing machine. Thereafter, the resultant steel sheet was dipped in a solution mixture (pH=3.0) of 1.5% of NaCl and 1.5% of citric acid (at 70° C. for 20 hours) and then rinsed with water and dried. Then, a tape peeling test was performed to estimate under film corrosion. The result was shown in Table 2.

A full-open end can was manufactured using the above steel sheet as a can body and aluminum as a can top, and a solution similar to that in the tape peeling test was filled therein as an imitation solution, thereby performing a real can test for three months. The result is shown in Table 2.

TABLE 2

| No. | Al | Cr | Al/Cr + Al | UFC | BMC |
|---|---|---|---|---|---|
| Comparative Example 1 | 1.0 | — | 1.0 | x | o |
| Comparative Example 2 | 0.6 | 0.5 | 0.55 | x | o |

TABLE 2-continued

| No. | Al | Cr | Al/Cr + Al | UFC | BMC |
|---|---|---|---|---|---|
| Present Invention 3 | 0.3 | 0.3 | 0.50 | o | o |
| Present Invention 4 | 0.3 | 0.6 | 0.33 | o | o |
| Present Invention 5 | 0.1 | 0.4 | 0.20 | o | o |
| Present Invention 6 | 0.1 | 0.2 | 0.33 | o | o |
| Comparative Example 7 | 0.03 | 0.2 | 0.13 | x | x |
| Comparative Example 8 | — | 0.5 | 0 | x | x |

UFC: under film corrosion
BMC: bimetallic corrosion
o: corrosion is absent, under film property is good
x: corrosion is present, under film property is poor Table 2 shows that the under film property can be improved by forming chromium and aluminum layers having thicknesses according to the present invention.

What is claimed is:

1. An aluminum-plated steel for cans, comprising:
a steel sheet;
an electroplated chromium layer, formed on the surface of said steel, substantially not having a hydrated chromium oxide layer, and having a thickness of 0.005 to 0.05 μm; and
an aluminum plating layer, formed on the surface of said electroplated chromium layer, and having a thickness of not less than 0.01 μm.

2. A can comprising a can body made of a steel according to claim 1 and a can top made of aluminum.

3. An aluminum-plated steel sheet for cans, comprising:
a steel sheet;
a chromium layer having a thickness of 0.1 to 0.7 μm; and
an aluminum layer having a thickness 0.4 μm.

4. A steel sheet according to claim 3, wherein the thickness of said chromium layer is 0.2 to 0.5 μm, and the thickness of said aluminum layer is 0.1 to 0.3 μm.

5. A can comprising a can body made of a steel sheet according to claim 3 and a can top made of aluminum.

* * * * *

UNITED STATES PATENT AND TRADEMARK OFFICE

CERTIFICATE OF CORRECTION

PATENT NO. : 4,906,533

DATED : March 6, 1990

INVENTOR(S) : KAGECHIKA et al

It is certified that error appears in the above-identified patent and that said Letters Patent is hereby corrected as shown below:

Column 8, Claim 3 (line 53):

"thickness 0.4 μm" should be --thickness of 0.05 to 0.4--.

Signed and Sealed this

Eighteenth Day of May, 1993

*Attest:*

Michael K. Kirk

MICHAEL K. KIRK

*Attesting Officer*

*Acting Commissioner of Patents and Trademarks*